United States Patent [19]

Taylor et al.

[11] Patent Number: 4,489,949

[45] Date of Patent: Dec. 25, 1984

[54] FEATHERLESS ARROW

[76] Inventors: Donald M. Taylor, 2691 Ravenna Rd.; Thomas H. Whittaker, 2233 Ravenna Rd., both of Hudson, Ohio 44236

[21] Appl. No.: 548,442

[22] Filed: Nov. 3, 1983

Related U.S. Application Data

[63] Continuation of Ser. No. 354,721, Mar. 4, 1982, abandoned.

[51] Int. Cl.[3] ..... F41B 5/02

[52] U.S. Cl. ..... 273/423; 273/416; 244/3.3

[58] Field of Search ..... 273/416, 419, 420, 423; 102/384, 293, 486; 244/3.26, 3.3

[56] References Cited

U.S. PATENT DOCUMENTS

| | | | |
|---|---|---|---|
| 23,538 | 4/1859 | Arnold | 244/3.3 |
| 399,880 | 3/1889 | Graydon | 244/3.3 X |
| 2,179,404 | 11/1939 | Fabionar | 273/420 |
| 3,292,879 | 12/1966 | Chilowsky | 244/3.3 |
| 3,586,332 | 6/1971 | Alban | 273/416 |
| 3,751,037 | 8/1973 | Courneya | 273/423 |
| 4,050,696 | 9/1977 | Troncoso | 273/420 |

FOREIGN PATENT DOCUMENTS

| | | | |
|---|---|---|---|
| 2029711 | 3/1980 | United Kingdom | 273/416 |

*Primary Examiner*—Paul E. Shapiro
*Attorney, Agent, or Firm*—Oldham, Oldham & Weber

[57] ABSTRACT

The invention teaches an improved arrow construction which, by the partial or complete elimination of tail feathers as a means for stabilizing flight trajectory, improves both the speed and the accuracy of the arrow. A resilient stabilizing tail is substituted for tail feathers which substantially eliminates aerodynamic drag. In addition, the invention contemplates the use of a "shock piston" within the interior of the arrow shaft which serves to increase arrow penetration in the target by striking the arrow head after the initial target impact.

10 Claims, 7 Drawing Figures

FEATHERLESS ARROW

CROSS-REFERENCE

This is a continuation application of application Ser. No. 354,721 filed Mar. 4, 1982 now abandoned.

TECHNICAL FIELD

The invention relates to an arrow lacking the usual tail feathers used to stabilize the arrow during flight. An aerodynamic tail is utilized which increases the accuracy and velocity of the arrow.

BACKGROUND ART

Heretofore, many improvements to the basic design of the arrow have been suggested, a majority of which are modifications for specialized uses. The present invention provides for an arrow having an improved aerodynamic design which may be incorporated in arrows having a variety of general or specialized uses. This improvement is achieved by elimination of the usual tail feathers and the use of what is hereinafter called an aerodynamic tail. The aerodynamic tail contains a semi-rigid, whip-like stabilizer which is maintained within the hollow interior of the arrow prior to and during arrow launch. Means are provided for slidable securement so that, as the arrow leaves the bow string after launch, the sudden acceleration forces the stabilizer rearward so that it protrudes from the rear of the arrow through an aperture in the nock.

No prior art patents or publications have been found which teach such a device.

U.S. Pat. No. 4,093,229 refers to an arrow having a hollow shaft which is filled with a trail indicating dye material which is released when a moving target such as a deer or other animal is hit, thereby clearly showing the path taken by the wounded animal. This reference lacks any suggestion of an aerodynamic tail. Further, the arrow of this invention uses feathers.

U.S. Pat. No. 4,050,696 refers to an archery arrow which includes a shaft having ball bearings or a threaded weight plug at the front end. Conventional feathers are used.

U.S. Pat. No. 1,328,967 concerns an arrow incorporating an explosive charge and optionally a whistle. Although the arrow incorporates no feathers, there is no suggestion of applicants' aerodynamic tail.

U.S. Pat. No. 2,209,672 provides for means whereby an arrow may be caused to rotate or spin about its longitudinal axis in flight. While this patent recognizes some of the shortcomings inherent with the use of feathers, it fails to teach or suggest the use of a device similar to applicants'.

U.S. Pat. No. 2,245,187 provides for an arrow having a novel nock design, wherein leaf springs are used to provide additional impetus to the arrow as it is released from the bow string. While this invention does not make use of tail feathers, there is no teaching of any device similar to applicants'.

U.S. Pat. No. 1,989,847 teaches a method whereby arrows may be made in quantities with substantially uniform results as to weight, balance, and a high degree of straightness. The invention employs a metallic tubular shaft and feathers.

U.S. Pat. No. 2,620,190 relates to a tip for a dart or arrow. No device similar to the applicants' invention is apparent, and the trailing edge of the device contains fins, as in conventional arrows or darts.

U.S. Pat. No. 1,999,601 describes an arrow having a shaft of tubular metal. Specifically, the invention refers to a means for absorbing sound vibrations peculiar to that of tubular metal arrow shafts. Nothing remotely similar to applicants' invention is disclosed.

U.S. Pat. No. 3,393,912 refers to a novel self-contained mechanical means for allowing a hunter to track the flight of his wounded prey by means of a blood flow tube passage in the arrow shaft, which allows a trail of blood to be deposited upon the ground as the animal flees. The arrow described contains feathers and has no device similar to applicants' invention.

U.S. Pat. No. 3,207,157 discloses a means for the administration of drugs and medicines to animals. The invention describes a projectile in the form of a hypodermic syringe. There is no disclosure of an aerodynamic tail, as in applicants' invention.

U.S. Pat. No. 1,907,273 refers to an arrow gun and, although an arrow is also described, there is no description of an aerodynamic tail.

DISCLOSURE OF INVENTION

It is an object of the present invention to provide an arrow having improved aerodynamic characteristics resulting in increased flight stability, speed, and accuracy.

It is another object of the instant invention to provide an arrow, as above, which has no feathers and which utilizes an aerodynamic tail.

It is yet another object of the present invention to provide an arrow, as above, in which the aerodynamic tail is slidably mounted within the hollow interior of the arrow shaft and which protrudes from the rear of the arrow after it is released from the bow string.

It is still another object of the present invention to provide an arrow, as above, which incorporates a novel nock design which facilitates assembly of the arrow and which aids in the operation of the aerodynamic tail.

It is still another object of the present invention to provide an arrow, as above, which optionally has incorporated therein a shock piston which increases the impact force of the arrow upon the target.

It is yet another object of the present invention to provide an arrow, as above, optionally containing apertures which aid in the operation of the aerodynamic tail.

It is still another object of the present invention to provide an arrow, as above, in which the aerodynamic tail optionally may be weighted to provide additional impact force on the target.

It is still another object of the present invention to provide an arrow having a small or short aerodynamic tail in which flight stability is imparted to an arrow having tail feathers.

These and other objects of the present invention, which will become apparent as the detailed description proceeds, are achieved by: a featherless arrow, comprising an arrow shaft having at least a hollow rear section; a nock secured to the rear of said arrow shaft and having an aperture therein; and an aerodynamic tail located within said hollow rear section.

Additionally, a featherless arrow comprises: an arrow shaft having therein at least a hollow section; a dash pot positioned at the front end of said hollow section; a shock piston slidably located within said hollow section; and means for releasable securement of said shock piston at the rear of said hollow section.

Additionally, a featherless arrow comprises: an arrow shaft having at least a hollow rear section; a nock secured to the rear of said arrow shaft and having an aperture therein; at least a feather secured to the rear of said arrow shaft; and an aerodynamic tail located within said hollow rear section of said arrow.

BRIEF DESCRIPTION OF DRAWINGS

For a further understanding of the objects, techniques, and structure of the invention, reference should be had to the following detailed description and accompanying drawings, wherein.

BEST MODE FOR CARRYING OUT THE INVENTION

Arrows generally require some means of stabilization to improve their flight characteristics. The most widely used form of arrow stabilization has heretofore been feathers secured at the rear of the arrow. Tail feathers do much to maintain the proper flight path of the arrow and thereby to improve accuracy. However, tail feathers also have the disadvantage of introducing a significant amount of aerodynamic drag on the arrow, which consequently reduces the velocity and thereby the range and impact of the arrow.

Figure 1:
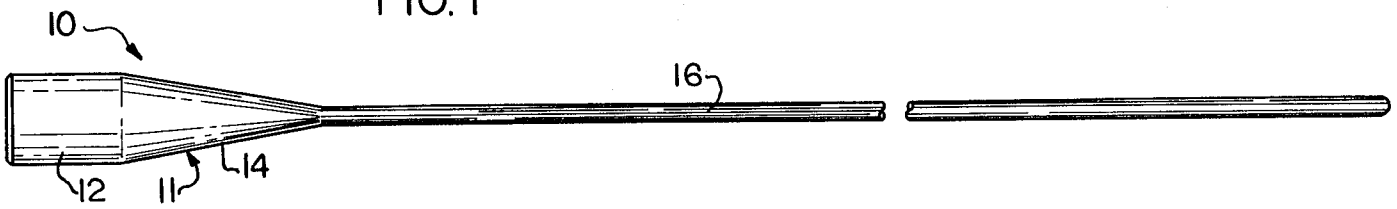
FIG. 1 is the aerodynamic tail of the instant invention.
Figure 3:
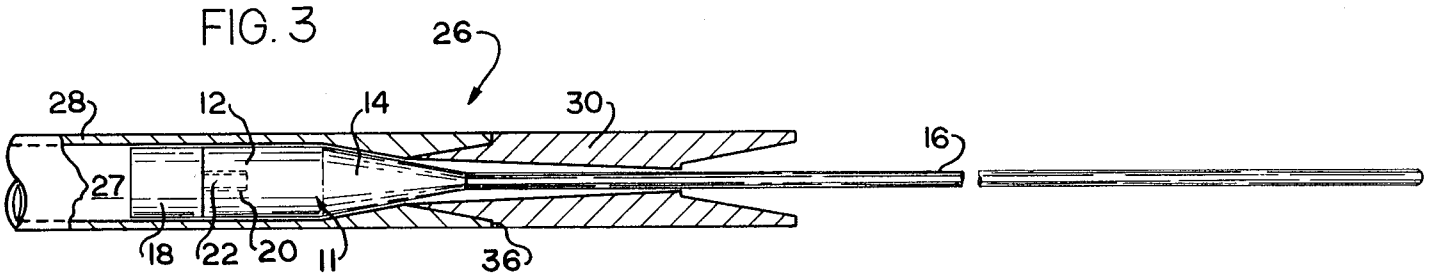
FIG. 3 is another cross-sectional view of the rear portion of the featherless arrow showing a portion of the aerodynamic tail extending from the arrow.
Figure 2:
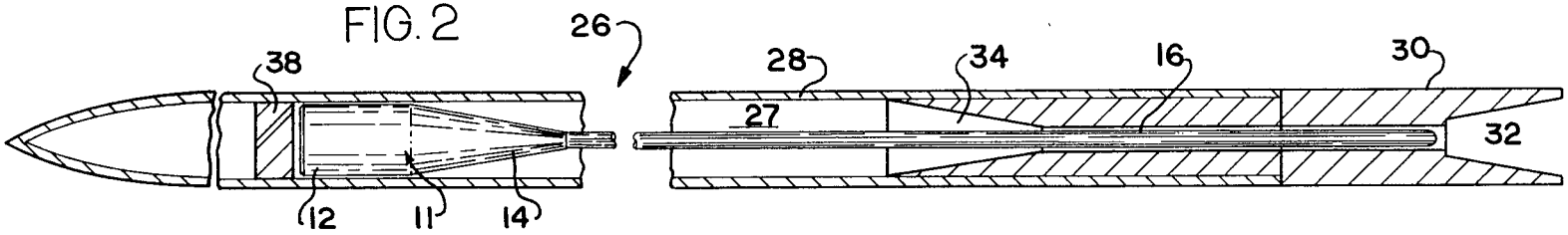
FIG. 2 is a cross-sectional view of the rear portion of a featherless arrow.

The instant invention improves the stability of arrows with or without the use of tail feathers. The invention can be seen with reference to the figures, and in particular to FIG. 1 wherein the aerodynamic tail of the invention is designated by the number 10. The tail 10 is positioned within the hollow interior of an arrow, as in FIGS. 2 and 3, wherein is shown the rear portion of a featherless arrow designated by the number 26. Arrow 26 can have a rear hollow portion but is preferably hollow throughout and is made from any conventional material such as wood, metal, e.g., aluminum, plastic, fiberglass, and the like. Aerodynamic tail 10 contains, in general, two portions, a retainer portion generally indicated by the number 11 and a stabilizer portion 16. Retainer portion 11 has a head 12 with one end desirably having a taper 14. The aerodynamic tail is slidably mounted within the rear of the arrow 26 so that, as a comparison of FIGS. 2 and 3 shows, it is easily repositioned within the hollow 27 of the arrow. Although a particular embodiment is shown, retainer portion 11 can be of any shape, configuration, or size as long as it is slidably located within the hollow portion of arrow 26 and retains stabilizer 16 to the arrow (although said stabilizer extends therefrom), as shown in FIG. 3. Moreover, the retainer can simply be of a unitary configuration, such as simply a cylinder, a frustrum, a cone, etc., having the stabilizer extending therefrom.

The tail 10 can optionally have a head weight 18 which is secured to the head 12 by suitable means, as shown in FIG. 3. Preferably, the head weight is removably secured as shown, in which the head weight 18 is secured by means of a threaded bolt 22 and a threaded aperture 20 within the head 12. The purpose of the head weight 18 is to increase the overall weight of the aerodynamic tail 10 which may be required to balance the weight of the arrow or to act in the manner of a "shock piston," as will be explained hereinafter.

The aerodynamic tail 10 operates to stabilize the flight of the arrow in the following manner. Prior to launching of the arrow, the tail 10 is usually positioned so that the stabilizer 16 is fully withdrawn into hollow interior 27 of arrow, see FIG. 2. In this position, the operation of a nock 30 in launching the arrow is unimpeded. An optional shaft block 38 can be used to prevent the tail 10 from sliding too far forward into the shaft hollow 27. Shaft block 38 is preferably located such that its distance from nock aperture 32 is equal to or slightly greater than the length of aerodynamic tail 11. The arrow is launched in the usual manner with the nock positioned on the bow string (not shown), the arrow drawn back and then released. With the sudden acceleration of the arrow, the aerodynamic tail 10 is driven rearward by inertia until its movement is halted by means of the taper 14 engaging nock taper 34. During flight, the slight aerodynamic drag produced by the stabilizer 16 causes it to remain in the fully extended position. The positions of the aerodynamic tail 10 before and after launching of the arrow are illustrated in FIGS. 2 and 3 respectively.

The stabilizer 16, which generally is cylindrical, extends outward from the rear of the nock 30 through nock aperture 32 located in the center of the nock. Stabilizer 16 is preferably made of flexible or resilient materials which impart to the stabilizer a whip-like quality, such as plastics, including nylon, polyamide, polystyrene, polyethylene, polypropylene, polyvinylchloride, and copolymers thereof, spring steel, aluminum, and the like. Various other plastics, metals, etc., can be used as long as they possess the requisite flexibility. It is this quality of the stabilizer which imparts stability to the arrow during its flight.

Retainer 11 can be constructed of suitable materials such as metals, including steel, aluminum, and the like, or plastics such as nylon, polyethylene, polypropylene, and other plastics known to those skilled in the art. Nock 30 can be constructed of similar materials.

When the arrow deviates from a straight flight path, it is thought that the deviation is translated into a force exerted upon stabilizer 16, which then, in a manner analogous to a spring, exerts an equal but opposite force upon the arrow, thus causing the arrow to return to the original flight path. Thus, in effect, the deviations are damped out. The degree of resilience or flexibility should be such that enough is present to allow considerable flexing of the stabilizer 16 during flight, yet not so much that the stabilizer loses the ability to maintain an accurate flight path, that is, there must be an amount of stiffness so that a resilient or spring quality is achieved and the resilient or spring force is therefore translated to the nock. The correct balance of flexibility versus stiffness in the stabilizer is generally a function of the length and weight of the arrow 26 and the length, material of construction and cross-sectional area of the stabilizer 16. The length of said stabilizer can vary between 3 percent and 70 percent of the length of arrow 26, as from 20 to 55 percent, desirably between 30 and 40 percent and preferably about 35 percent.

As can be seen from the figures, the lack of tail feathers imparts a streamlined shape to the arrow shaft 28. This streamlining is further enhanced by the recessed design of the nock 30. A circumferential recess 36 allows the nock 30 to be assembled into the arrow shaft 28 in such a manner that the nock and the arrow shaft join to provide a smooth surface. By contrast, the nocks of conventional, prior art arrows are assembled over the arrow shaft, and thus present an increased cross-sectional area to the airstream during arrow flight, which increases drag.

This improved nock design of arrow 26 also facilitates the manufacture of the arrow. Prior art arrows, usually constructed of aluminum or other lightweight metals or alloys, are generally hollow with a rear tip which has been tapered to a point. Over this rear tip is fitted a nock, as above. A great deal of the expense and time involved in producing a prior art arrow concerns the machining of the arrow shaft to produce this tapered rear tip.

The arrow of the present invention, however, eliminates the need for a tapered tip by the use of nock 30. Arrow 26 may thus be manufactured using plastics, fiberglass, aluminum or other lightweight metals or alloys such as steel, titanium, etc., as are the prior art arrows, yet a great deal of the cost is eliminated because hollow open ended arrow shafts are simply made through extrusion or other means and nock 30 fitted thereto. There is no need for a tapered rear tip. Similarly, arrows made of wood, plastic or fiberglass can be manufactured without providing a tapered rear tip.

Figure 4:
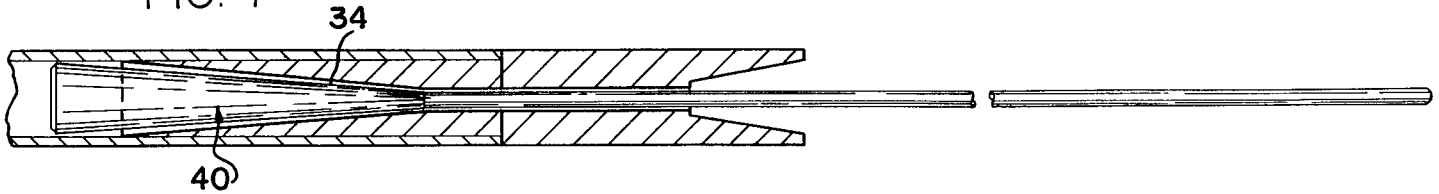
FIG. 4 is a cross-sectional view of the rear portion of a featherless arrow incorporating a second retainer design.

An alternative embodiment for a retainer is shown in FIG. 4 in which retainer 40 differs from retainer 11 by its more elongated and tapered shape. Retainer 40 thus provides more of a mating surface to nock taper 34 which allows for increased engagement during arrow flight. Retainer 40 is constructed of the same materials as retainer 11 and can have an optional head weight (not shown) similar to head weight 18.

Aerodynamic tail 10, having retainer 11 or retainer 40, can be used as a "shock piston," that is, the kinetic energy of the tail can be used to create a secondary impact after the arrow strikes the target. This effect is produced by reason of the slidable securement of the tail 10 within the hollow interior 27, allowing tail 10 to slide forward within the hollow after the initial impact. The kinetic energy produced by this forward motion of tail 10 is translated into an additional forward movement of the arrow 26 when tail 10 strikes the forward end of hollow 27. Arrow 26 is thus driven deeper into the target.

As kinetic energy is directly proportional to mass, the "shock piston" effect can be increased by increasing the weight of the retainer 11 or retainer 40 through the addition of head weight 18. Generally, the desired effect can be achieved with the addition of a small amount of weight which causes little or no alteration of the balance of the arrow. However, the speed of the arrow will contribute much to the "shock piston" effect.

Alternatively, the shock piston effect can be minimized by the use of shaft block 38. As mentioned above, this device operates to prevent the aerodynamic tail from sliding too far forward into the shaft hollow 27. It has been discovered that if the aerodynamic tail 10 is not positioned prior to arrow launch such that the end of stabilizer 16 lies near aperture 32, sudden acceleration of the arrow upon releasement drives the tail 10 rearward with such force that the arrow can be damaged. As noted, the length of travel of the tail 10 is minimized by locating shaft block 38 so that the rear tip of stabilizer 16 is near aperture 32 when the front tip of retainer 11 or retainer 40 is touching shaft block 38.

Another advantage of the instant invention is that contact between the arrow 26 and the bow stave is minimized. Besides the above-noted aerodynamic drag, the use of feathers also causes a loss in velocity and accuracy as the arrow rubs against the bow stave immediately after releasement. Further, contact with the bow stave can eventually cause the feathers to be frayed, collapsed, or otherwise rendered inoperable and thus requiring periodic replacement. The instant invention, however, by eliminating the need for tail feathers, removes this source of contact and simultaneously the need for feather maintenance.

Figure 6:
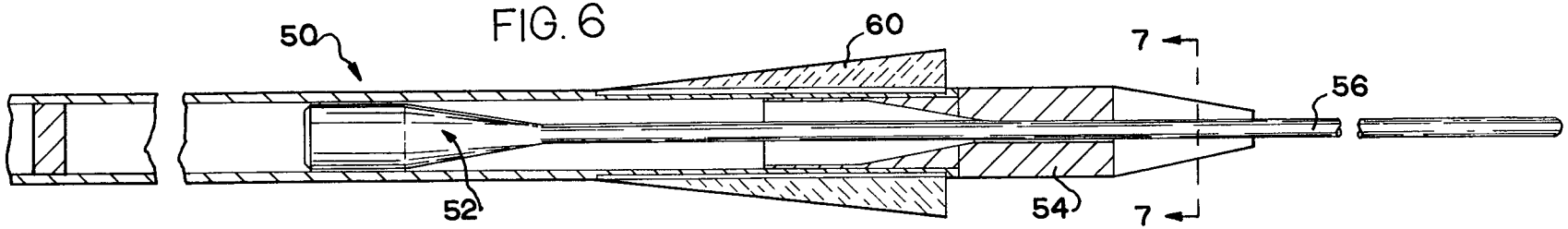
FIG. 6 is a cross-sectional view of the rear portion of another embodiment of this invention.

Another embodiment of this invention can be seen with reference to FIGS. 6 and 7, wherein an aerodynamic tail 52 is utilized which is similar to embodiment 10 described hereinabove. The rear section of an arrow, designated generally by the number 50 has generally a shortened stabilizer 56 and provides less of a stabilization effect than does the stabilizer 16 of the previous embodiment. Stabilization is aided through the use of residual feathers 60. In general, shortened stabilizer 56 has a length dictated by the same considerations as in the first embodiment and, in general, is between about 2 percent and 70 percent of the total length of the arrow, desirably from 2 to 40 percent, and preferably between 4 percent and 25 percent, with about 10 percent being most preferred.

Figure 7:
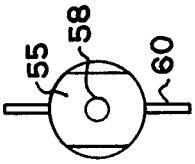
FIG. 7 is a rear end view taken on line 7—7 of FIG. 6.

Residual tail feathers 60 generally have smaller dimensions than prior art, conventional feathers and, as can be seen with reference to FIG. 7, can be positioned in the same plane as a notch 55 in a nock 54. With this configuration, contact between the bow stave and residual tail feathers 60 subsequent to release of the arrow is minimized, if not eliminated, and, thus, the advantages in this regard which were realized in the first embodiment are preserved to a large extent.

The number, for example, one, two, three, four, etc., and the size of the residual feathers 60 has a bearing on the length of the stabilizer 56, that is, the length of stabilizer 56 is generally inversely proportional to the size and number of feathers 60. Thus, at the one extreme, if feathers 60 are nearly the dimensions of conventional prior art feathers, stabilizer 56 has at an optimum a length of only a few percent or so of the length of the arrow. At the other extreme, if there is present only one or two feathers 60, and these are very, very small, the length of stabilizer 56 approaches the length which is optional for the featherless arrow.

Aerodynamic tail 52 can be constructed of the same materials recited in connection with aerodynamic tail 10. Nock 54 is similar in design to nock 30 except that an aperture 58 can be somewhat smaller to accomodate a reduced diameter of stabilizer 56. Aerodynamic tail 52 can act as a shock piston in a manner similar to that described hereinabove. Tail 52 can in addition contain a head weight (not shown) to aid in this regard. A shaft block can also be located within the arrow at a distance as discussed above with regard to FIGS. 1, 2, and 3.

Figure 5:
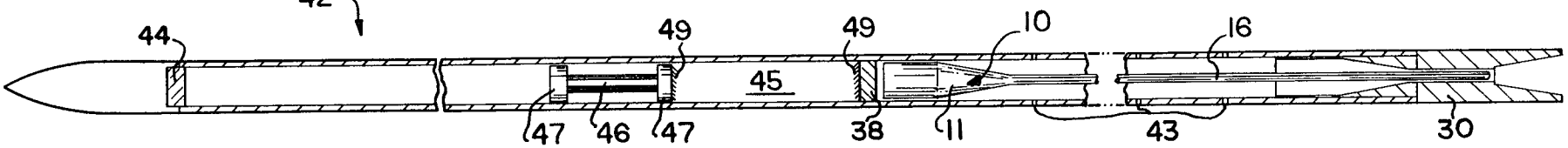
FIG. 5 is a cross-sectional view of the featherless arrow, incorporating various optional features.

Turning now to FIG. 5, it is seen that a complete view of an arrow is designated generally by the number 42. In this embodiment, arrow 42 incorporates aerodynamic tail 10, retainer 11, nock 30, and stabilizer 16, as in FIGS. 1, 2, and 3. Alternatively, the embodiment of FIGS. 5 and 6 could also be used. Arrow 42 optionally has a plurality of air intake apertures 43 located to the rear of shaft block 38. Apertures 43 are designed to allow outside air to enter shaft hollow 27 during arrow flight, which creates a whistling sound and also aids in retaining tail 10 in nock 30 during arrow flight.

A shock piston effect is produced by a shock piston 46 located in a hollow portion 45 of the arrow and separated from the aerodynamic tail by shaft block 38, or a different shaft block, if required. As shown in FIG. 5, the shock piston 46 contains piston heads 47 at either end which provide close tolerance, slidable securement in hollow 45. However, the actual physical shape of shock piston 46 is not significant other than that it conform reasonably well at appropriate locations to the surface of the hollow. For instance, shock piston 46 may be cylindrical in shape, having a length and consequently a mass which is consistent with the requirements for maintaining the required balance of the arrow.

Shock piston 46 utilizes kinetic energy in a manner similar to that described above with regard to the aerodynamic tail. However, rather than be secured during flight by a taper and aerodynamic drag, shock piston 46 is secured to shaft block 38 by suitable means, for example, a magnet, or, as shown in FIG. 5, hook and loop fasteners 49, one portion of which is secured to the frontal area of shaft block 38 and the other to the rear surface of rear piston head 47. Other conventional forms of releasable securement can also be used.

In operation, the sudden deceleration of the arrow upon striking the target causes releasement of shock piston 46 from shaft block 38 and allows it to continue forward until it strikes a dash pot 44. The impact drives the arrow further into the target.

A shock piston can be incorporated in an arrow other than a featherless arrow as long as the arrow has at least a hollow section. For example, a conventional arrow having a hollow section can have a shock piston 46 releasably secured to the rear of said hollow section.

The shock piston 46 can be constructed of various conventional materials, with metals such as steel or aluminum and various hard plastics being preferred. Examples of plastics include nylon, acrylonitrile-butadiene-styrene, polyethylene, and other similar homopolymers and copolymers. The weight of shock piston 46 of course varies with the size and density of the material used.

It is desirable that the center of gravity of the shock piston coincide as close as possible with the center of gravity of the arrow during flight so as to facilitate an accurate trajectory. Thus, the rear wall of the hollow section, be it a shaft block 38, or another shaft block, or a solid portion of the arrow shaft must be positioned approximately at the center of gravity of the arrow 42 or slightly behind it (to account for the length of the shock piston).

Arrow 42 may be of a length and outer diameter which is conventional in the art, such a length of between about 6 and 40 inches. Further, it will be appreciated that conventional arrows can be modified to include either or both the aerodynamic tail and the shock piston. For example, it has been discovered that if an aerodynamic tail is affixed to a conventional arrow (having the usual size and number of feathers), the flight of the arrow is more stable, resulting in improvements in velocity and accuracy, though generally they are not as great as with the featherless arrow 42, or with an arrow in which the size of the feathers and the stabilizer have been optimized, as described hereinabove.

While the above description sets forth the scope of the invention, the following examples can illustrate best the preferred embodiments.

EXAMPLE 1

A 62 pound compound bow was used to shoot both a conventional, prior art arrow and a featherless arrow of the present invention. The conventional arrow with three feathers thereon, was an Easton 2018 having a length of 31 inches, an outer diameter of 20/64 inches, and a wall thickness of 0.018 inches. The material of construction was 7075 aluminum alloy having a tensile strength of 96,000 psi. The featherless arrow was made by inserting an aerodynamic tail and the nock of the instant invention into an Easton 2018 arrow as above from which the conventional nock and feathers had been removed. The aerodynamic tail and the nock were constructed of nylon. The stabilizer length was $12\frac{1}{4}$ inches with a diameter of $\frac{1}{8}$ inches. No shaft block or shock piston was utilized.

The speed of each arrow was measured by standard archery light chronograph. The conventional arrow attained a speed of 152 feet per second compared to 238 feet per second for the featherless arrow.

EXAMPLE 2

The same arrows were used as in Example 1, except that a 77 pound compound bow was utilized. The conventional arrow attained a speed of 284 feet per second, while the featherless arrow attained 338 feet per second. Easton arrows can be obtained from Jas. D. Easton, Inc., 7800 Haskell Avenue, Van Nuys, Calif. 91406.

These examples illustrate the improvements in velocity realized with the use of the featherless arrow of the present invention. Since increased speed results in a flatter and more predictable trajectory, accuracy is also improved.

While in accordance with the patent statutes, only the best mode and preferred embodiments have been disclosed herein, it is to be understood that the invention is not limited thereto or thereby. Therefore, for a true understanding of the scope of the invention, reference should be made to the following appended claims.

What is claimed is:

1. An arrow, comprising:

an arrow shaft having an elongated longitudinally extending hollow rear section;

a tapered nock secured to the rear of said arrow shaft and having an aperture formed therein communicating with the hollow rear section of the shaft;

an aerodynamic tail movably mounted within said hollow rear section having a stabilizer and a retainer portion;

the stabilizer being formed of a flexible material and having an elongated configuration and being aligned with the nock aperture when mounted within the hollow rear section, with said stabilizer being smaller in the transverse direction than the nock aperture to permit said stabilizer to pass through said aperture upon launching of the arrow; and the retainer portion having a tapered head slidably movable within the hollow rear section of the arrow shaft providing slidable movement of said head along the length of said hollow section, with said head being larger in the transverse direction than the nock aperture and stabilizer so as to remain within the hollow rear section of the shaft after the stabilizer passes through the nock aperture upon launching of the arrow, and with the tapered head matingly engaging the tapered nock.

2. A featherless arrow according to claim 1, wherein the length of the stabilizer which extends outwardly beyond the nock aperture after launching of the arrow is between about 3 and 70 percent of the length of said arrow.

3. A featherless arrow according to claim 2, in which the arrow shaft is hollow generally throughout its length and has a shaft block therein; and in which the aerodynamic tail is located rearward of said block.

4. A featherless arrow according to claim 3, wherein said shaft block is positioned within said hollow arrow shaft a distance from the rear of said arrow equal to or slightly greater than the length of said aerodynamic tail.

5. A featherless arrow according to claim 4, wherein said retainer has a head in close tolerance within the surface of said hollow rear section of said arrow which provides slidable movement of said aerodynamic tail along the length of said hollow section.

6. The featherless arrow according to claim 1, wherein the arrow shaft is hollow generally throughout its length; in which a dash pot is positioned in a forward portion of said hollow shaft; in which a shock piston is slidably located within said hollow shaft and strikes the dash pot upon the arrow striking a target; and in which securement means is located within the hollow shaft rearward of the piston for releasably securing the piston rearward of the dash pot until the arrow strikes a target.

7. A featherless arrow according to claim 6, wherein the shock piston has at least a portion of its outer surface in close tolerance with the surface of said hollow shaft.

8. The featherless arrow according to claim 6, wherein the securement means includes a wall mounted in the hollow shaft dividing said shaft into the hollow rear section in which the aerodynamic tail is movably mounted and a hollow front section in which the shock piston is slidably located.

9. A featherless arrow according to claim 1, wherein said aerodynamic tail is constructed of material selected from the group consisting of spring steel, aluminum, and nylon, polyester, polyamide, styrene, polyethylene, polypropylene, and polyvinyl chloride.

10. A featherless arrow according to claim 9, wherein the length of said protruded stabilizer is between about 30 to 40 percent of the length of the arrow.

* * * * *